US009608384B2

(12) United States Patent
Soo

(10) Patent No.: US 9,608,384 B2
(45) **Date of Patent: *Mar. 28, 2017**

(54) LOW PROFILE CONNECTOR

(71) Applicant: Molex, LLC, Lisle, IL (US)

(72) Inventor: Foong-Ching Soo, Singapore (SG)

(73) Assignee: Molex, LLC, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/185,468

(22) Filed: Feb. 20, 2014

(65) Prior Publication Data

US 2014/0315433 A1 Oct. 23, 2014

(30) Foreign Application Priority Data

Feb. 20, 2013 (CN) ..... 2013 2 0079253 U

(51) Int. Cl.
*H01R 13/70* (2006.01)
*H01R 12/71* (2011.01)

(52) U.S. Cl.
CPC ..... *H01R 13/70* (2013.01); *H01R 13/701* (2013.01); *H01R 12/716* (2013.01)

(58) Field of Classification Search
CPC .. H01R 12/716; H01R 12/7094; H01R 13/70; H01R 13/701; H01H 9/0271
USPC .. 439/620.01, 630–631, 634, 637, 660, 668, 439/676, 682, 188; 200/51.09, 51.11
See application file for complete search history.

(56) References Cited

U.S. PATENT DOCUMENTS

| | | | | |
|---|---|---|---|---|
| 4,900,273 | A | 2/1990 | Pernet | |
| 5,013,255 | A | 5/1991 | Juret et al. | |
| 6,126,464 | A | 10/2000 | Chang | |
| 6,179,638 | B1 | 1/2001 | Lim | |
| 6,267,619 | B1 | 7/2001 | Nishioka | |
| 6,326,568 | B2 * | 12/2001 | Martucci et al. | 200/283 |
| 7,101,207 | B1 * | 9/2006 | Chi-Te | 439/188 |
| 7,427,206 | B2 | 9/2008 | Takei et al. | |
| 8,197,272 | B2 | 6/2012 | Matsunaga | |
| 2011/0117762 | A1 * | 5/2011 | Beak et al. | 439/188 |

FOREIGN PATENT DOCUMENTS

| | | | |
|---|---|---|---|
| CN | 201081824 | Y | 7/2008 |
| CN | 201278378 | Y | 7/2009 |
| CN | 201523134 | U | 7/2010 |

* cited by examiner

*Primary Examiner* — Felix O Figueroa
*Assistant Examiner* — Paul Baillargeon
(74) *Attorney, Agent, or Firm* — James A. O'Malley

(57) ABSTRACT

An electrical connector includes a housing, a cage and a switch unit. The housing has a base and a side wall connected to a side edge of the base. The cage and the housing together define a slot, and an entrance of the slot is on an end face. The switch unit is provided to the side wall. The side wall further has a mounting space that can receive the switch unit and a through-hole extending from the end face of the side wall into the mounting space along the card insertion direction so that a pin-like element can be inserted into the through-hole to enable the switch unit.

6 Claims, 11 Drawing Sheets

LOW PROFILE CONNECTOR

RELATED APPLICATIONS

This application claims priority to Chinese Application No. 201320079253.3, filed Feb. 20, 2013, which is incorporated herein by reference in its entirety.

TECHNICAL FIELD

The present disclosure relates to an electrical connector, and particularly relates to an electrical connector incorporated with a switch apparatus.

BACKGROUND ART

Generally, an electronic device, such as a computer, occasionally crashes during operation, at this time, the computer is required to reset so as to allow the computer to re-operate. In prior art, a switch apparatus with a button is used to turn on resetting of the computer, for example, Taiwanese patent publication No.TWM375307 (corresponding to Chinese patent grant publication No.CN201523134U) discloses a multiple-function connector which comprises a block, a switch module and an electrical connector, the switch module is provided in the block, when the computer crashes, a user inserts a pin-like element through a small through-hole in the block to push down a button cap of a button of the switch module, so that the computer may be reset, set or restarted.

However, the switch module in the previous patent document has a relative large volume, and is provided separately from the electrical connector, therefore the switch module occupies a considerable space of the block, which is not beneficial to providing a compact electronic device.

SUMMARY OF THE INVENTION

An electrical connector comprises a housing, a cage and a switch unit. The housing has a base and a side wall connected to a side edge of the base, the side wall extends along a card insertion direction and has an end face. The cage is engaged with the housing, the cage and the housing together define a slot, and an entrance of the slot is adjacent to the end face. The switch unit is provided to the side wall. The side wall further has a mounting space receiving the switch unit and a through-hole extending from the end face of the side wall and extending into the mounting space along the card insertion direction, a pin-like element can be inserted into the through-hole to enable the switch unit.

In an embodiment, the switch unit comprises an abutting portion formed to the cage and a resilient terminal fixed in the housing, the resilient terminal can be enabled by the pin-like element so as to change a contact state between the resilient terminal and the abutting portion.

In an embodiment, the resilient terminal has a pushed portion obliquely facing the through-hole, and a contact portion driven by the pushed portion, and the contact portion can contact the abutting portion. In an embodiment, the abutting portion is a protruding piece formed by integrally punching the cage and enters into the mounting space. In an embodiment, the abutting portion has resilience.

In an embodiment, the resilient terminal further has a fixed portion fixed to the housing and positioned above the through-hole, a connecting portion connecting the pushed portion and the contact portion, and a soldering portion extending from the fixed portion and extending out from the housing, the pushed portion extends obliquely and downwardly from a position of the fixed portion adjacent to the through-hole, and the connecting portion is reversely bent from the pushed portion and extends obliquely and upwardly, the contact portion extends from a distal end of the connecting portion and is separated from the abutting portion in a normal state, but when the pin-like element enters into the through-hole and contacts and pushes the pushed portion and the pushed portion in turn drives the connecting portion and the contact portion to move, the contact portion contacts the abutting portion.

In an embodiment, the resilient terminal further has a fixed portion fixed to the housing and positioned under the through-hole, and a soldering portion extending from the fixed portion and extending out from the housing, the pushed portion extends obliquely and upwardly from a position of the fixed portion adjacent to the through-hole, the contact portion extends from a distal end of the pushed portion and contacts the abutting portion in a normal state, but when the pin-like element enters into from the through-hole and pushes the pushed portion and the pushed portion in turn drives the contact portion to move, the contact portion is separated from the abutting portion.

BRIEF DESCRIPTION OF THE DRAWINGS

The other features and effects of the present disclosure will be apparent through the embodiments in combination with the Figures, and in which.

DETAILED DESCRIPTION OF THE PREFERRED EMBODIMENTS

Figure 1:
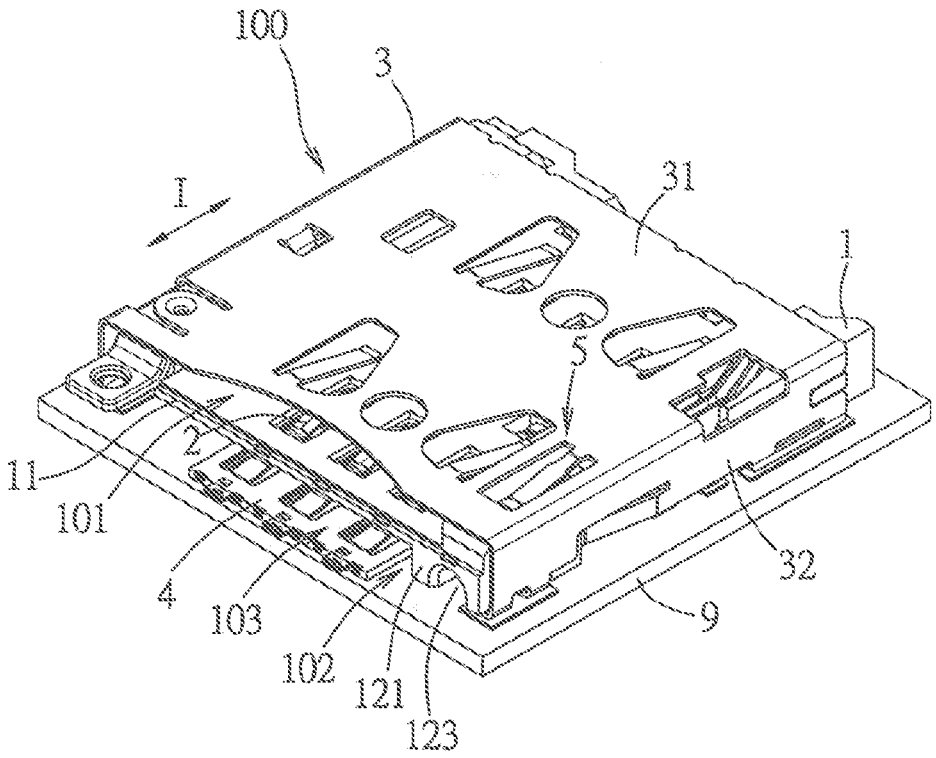
FIG. 1 is a perspective view illustrating a first embodiment of an electrical connector mounted on a circuit board.
Figure 2:
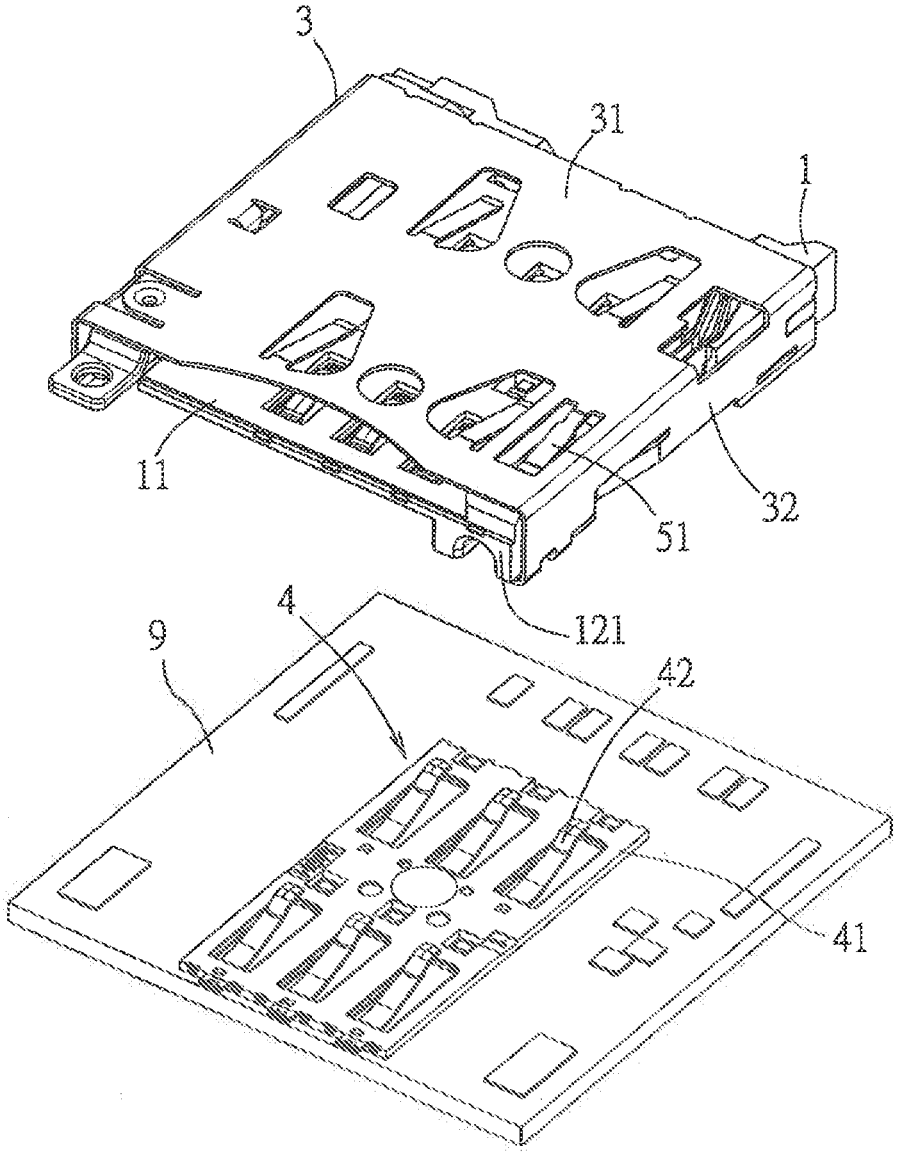
FIG. 2 is an exploded perspective view illustrating an assembling relationship of the first embodiment and the circuit board.
Figure 3:
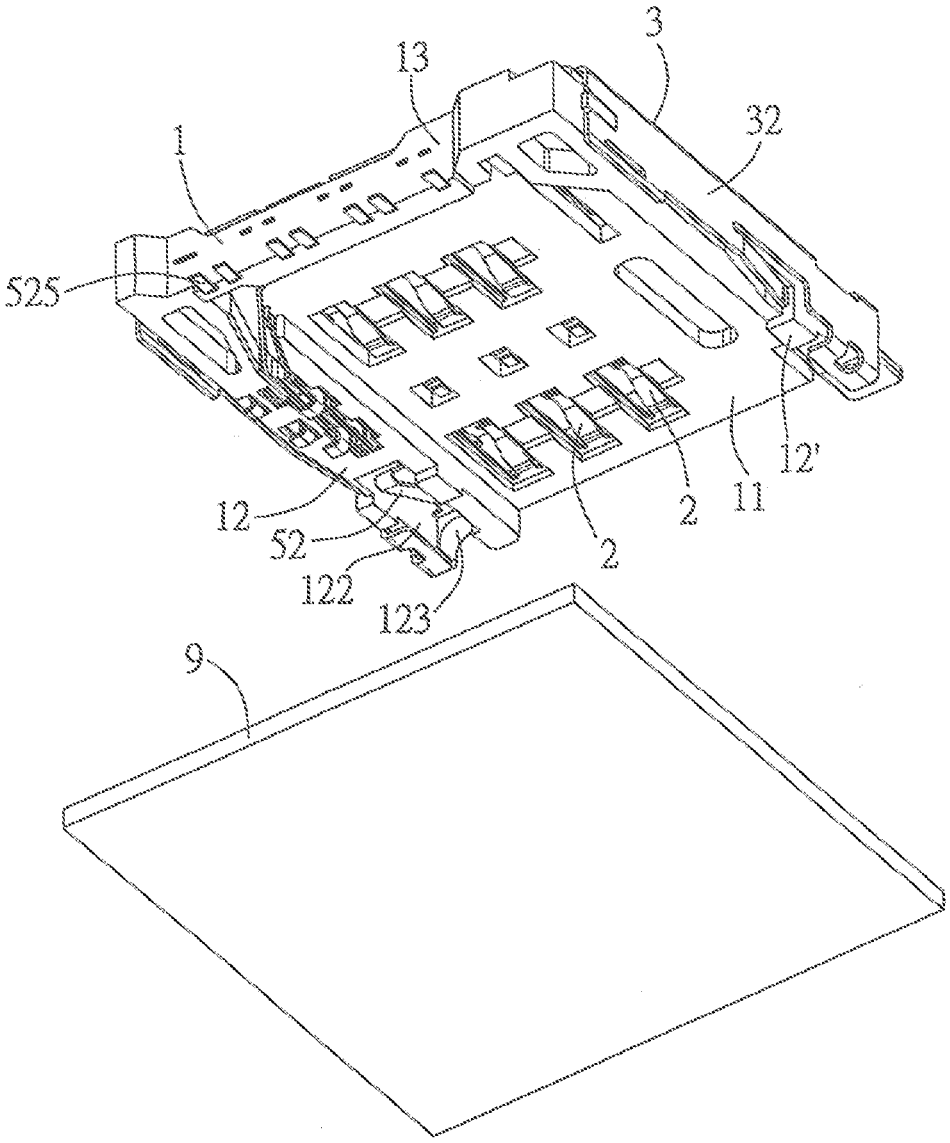
FIG. 3 is another perspective view of embodiment depicted in FIG. 2.

Before the present disclosure is described in detail, it should be noted that like elements are indicated by the same reference numerals in the following description. As can be appreciated, a benefit of the present disclosure is that the switch unit is provided to the side wall of the housing, the switch unit can be incorporated in the electrical connector, a space required to separately provide a switch apparatus is saved, and the configuration of the switch unit is simple, which also can reduce manufacture cost. Moreover, when the electrical connector is assembled in an electronic device, such as a mobile phone, once the mobile phone crashes, a user need not open the mobile phone, instead directly inserts the pin-like element into the through-hole from the outside of the casing so as to allow the pin-like element to enable the switch unit, therefore the reset function to restart the mobile phone can be achieved.

Referring to FIGS. 1-4, a first embodiment of an electrical connector 100 of the present disclosure is used to mount on a circuit board 9, the electrical connector 100 comprises a housing 1 (formed of an insulative material), a plurality of first terminals 2 provided to the housing 1, a cage 3, a terminal block 4 and a switch unit 5.

Figure 5:
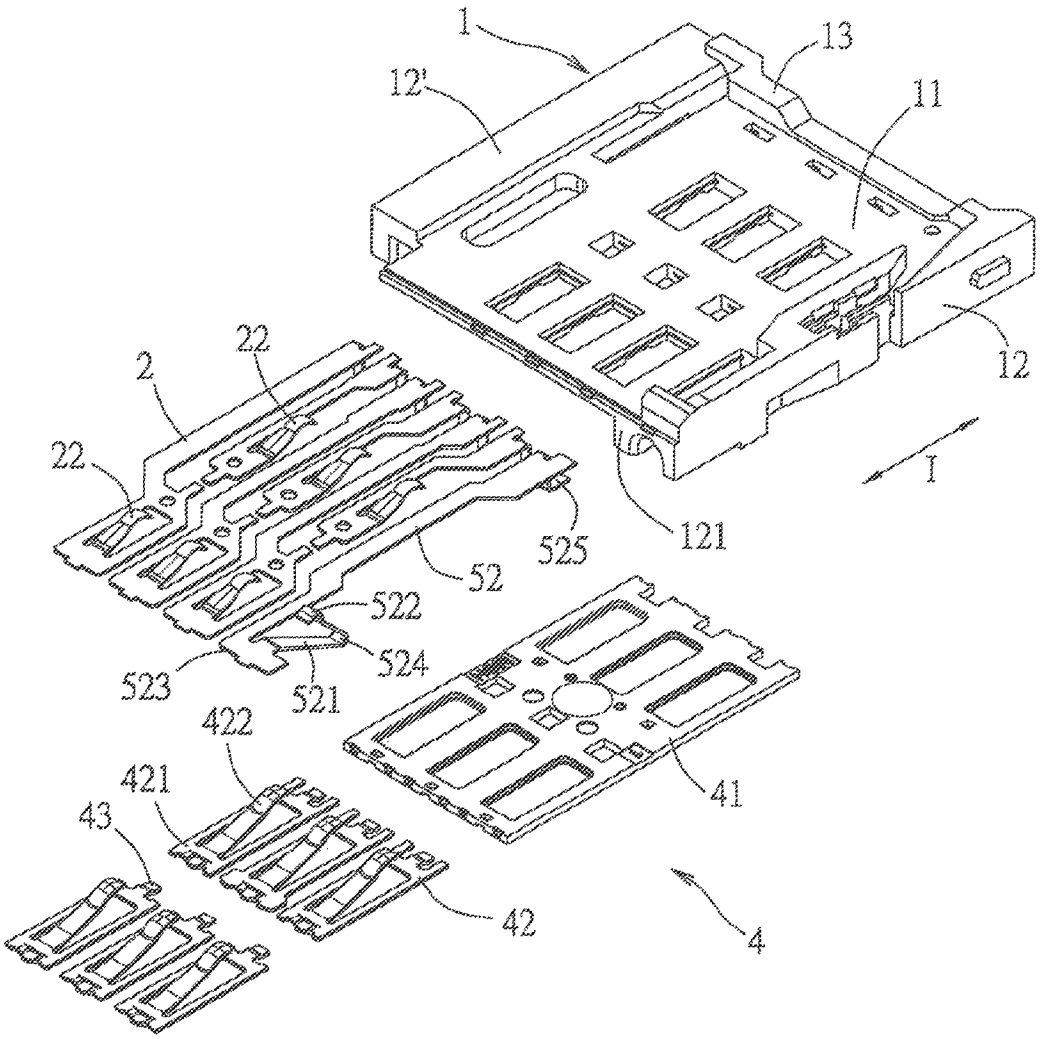
FIG. 5 is an exploded perspective view illustrating an engagement relationship among first terminals, second terminals, the housing and an insulative plate of the first embodiment.
Figure 6:
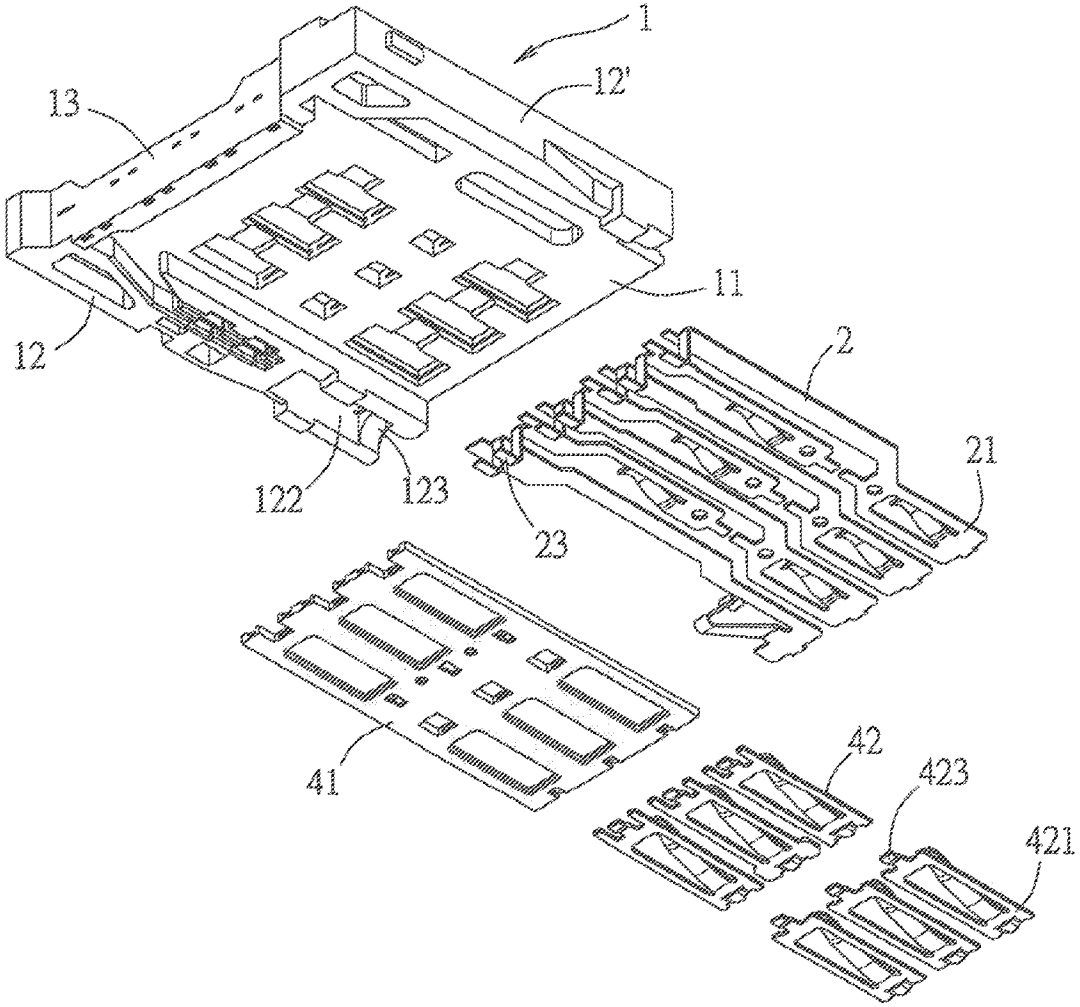
FIG. 6 is another perspective view of the embodiment depicted in FIG. 5.
Figure 7:
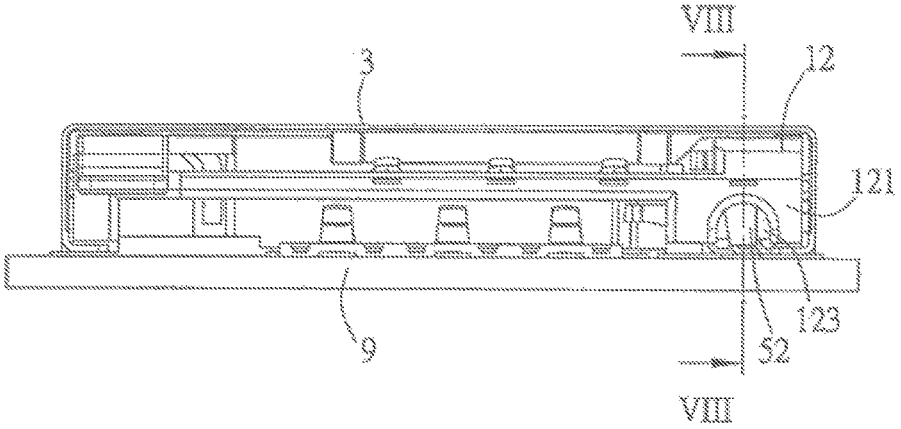
FIG. 7 is a front view illustrating a positional relationship between the switch unit and a through-hole.
Figure 8:
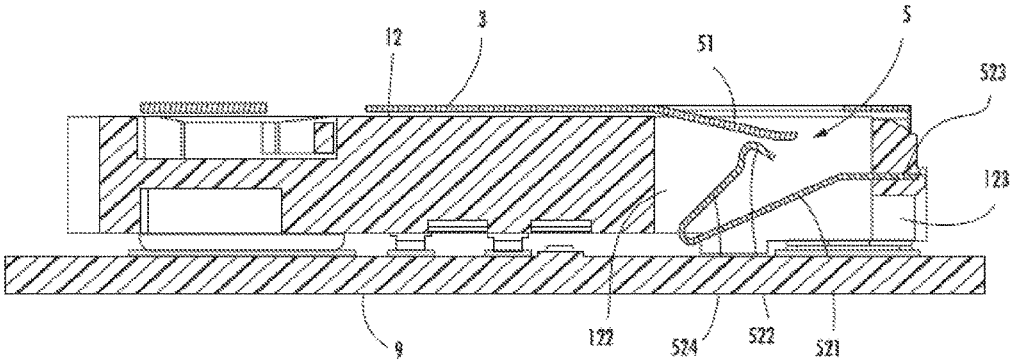
FIG. 8 is a cross sectional view taken along a line VIII-VIII of FIG. 7 and illustrating the switch unit in a normal state.

Referring to FIG. 1, FIG. 5 and FIG. 6, the housing 1 has a base 11, two side walls 12, 12' respectively connected to two side edges of the base 11, and a rear stop wall 13. The side walls 12, 12' respectively extend along a card insertion direction I, and the side wall 12 has an end face 121. The rear stop wall 13 connects the two side walls 12, 12' and is connected to a rear side of the base 11.

The cage 3 has a top plate 31 and two side plates 32 extending respectively from opposite sides of the top plate 31. The cage 3 and the housing 1 are engaged with each other and together define a slot 101, and an entrance of the slot 101 is adjacent to the end face 121. In the embodiment, the housing 1 and the circuit board 9 also together define a receiving space 102.

The terminal block 4 comprises an insulative plate 41 and a plurality of second terminals 42 provided to the insulative plate 41. The terminal block 4 is provided on the circuit board 9 and is positioned in the receiving space 102, and the insulative plate 41 and the base 11 are parallel to and spaced apart from each other and in turn together define another slot 103 in the receiving space 102. In the embodiment, the first terminals 2 and the second terminals 42 are respectively engaged with and fixed to the housing 1 and the insulative plate 41 by means of insert molding. The each first terminal 2 has a fixed portion 21 embedded in the housing 1, a resilient contact portion 22 extending from the fixed portion 21 and extending into the slot 101, and a soldering portion 23 extending from the fixed portion 21 and extending out from the rear stop wall 13 to be electrically connected to the circuit board 9. The each second terminal 42 has a fixed portion 421 embedded in the insulative plate 41, a resilient contact portion 422 extending from the fixed portion 421 and extending into the slot 103, and a soldering portion 423 extending from the fixed portion 421 and extending out from the insulative plate 41 to be electrically connected to the circuit board 9.

Referring to FIGS. 4-8, the switch unit 5 is provided to the side wall 12. Here, the side wall 12 further has a mounting space 122 receiving the switch unit 5 and a through-hole 123 extending from an end face 121 of the side wall 12 along the card insertion direction I and extending into the mounting space 122. The switch unit 5 comprises an abutting portion 51 formed to the cage 3, and a resilient terminal 52 fixed in the housing 1. The resilient terminal 52 has a pushed portion 521 facing obliquely the through-hole 123, and a contact portion 522 driven by the pushed portion 521, and the contact portion 522 can contact the abutting portion 51. In the embodiment, the abutting portion 51 is a protruding piece having resilience formed by integrally punching the cage 3, and extends into the mounting space 122 from the top plate 31. However, the abutting portion 51 also may be a local region of the cage 3, as long as the contact portion 522 of the resilient terminal 52 can contact the abutting portion 51.

Specifically, in the embodiment, the resilient terminal 52 and the first terminals 2 together are engaged with and fixed to the housing 1 by means of insert molding. And, the resilient terminal 52 further has a fixed portion 523 fixed to the housing 1 and positioned above the through-hole 123, a connecting portion 524 connecting the pushed portion 521 and the contact portion 522, and a soldering portion 525 extending from the fixed portion 523 and extending out from the rear stop wall 13 of the housing 1. The pushed portion 521 extends obliquely and downwardly from a position of the fixed portion 523 adjacent to the through-hole 123, and the connecting portion 524 is reversely bent from the pushed portion 521 and extends obliquely and upwardly, and the contact portion 522 extends from a distal end of the connecting portion 524 and is separated from the abutting portion 51 in a normal state. The soldering portion 525 is soldered to the circuit board 9 and is electrically connected to the circuit board 9, and the cage 3 is also soldered to the circuit board 9 and is electrically connected to the circuit board 9 so that the abutting portion 51 is also electrically connected to the circuit board 9. Because the resilient terminal 52 is separated from the abutting portion 51 in the normal state, so that the switch unit 5 is in an electrical disconnection in the normal state.

Figure 4:
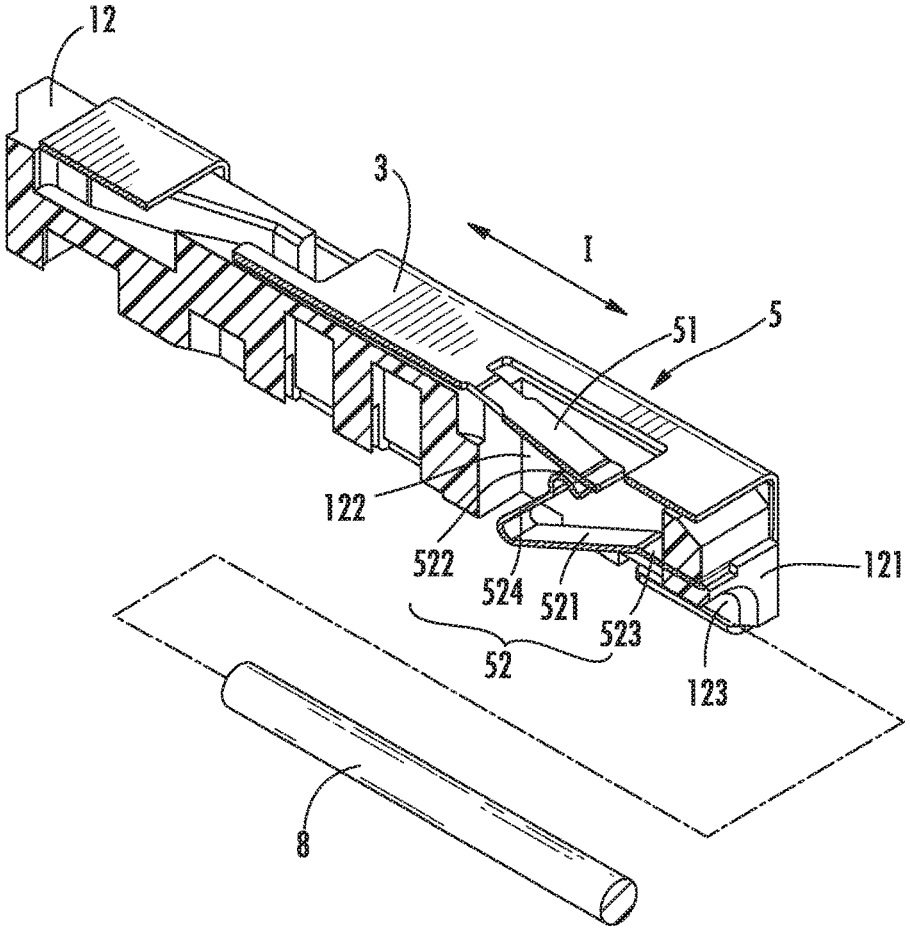
FIG. 4 is a perspective cut-away view illustrating an assembling relationship between a switch unit and an housing of the first embodiment.
Figure 9:
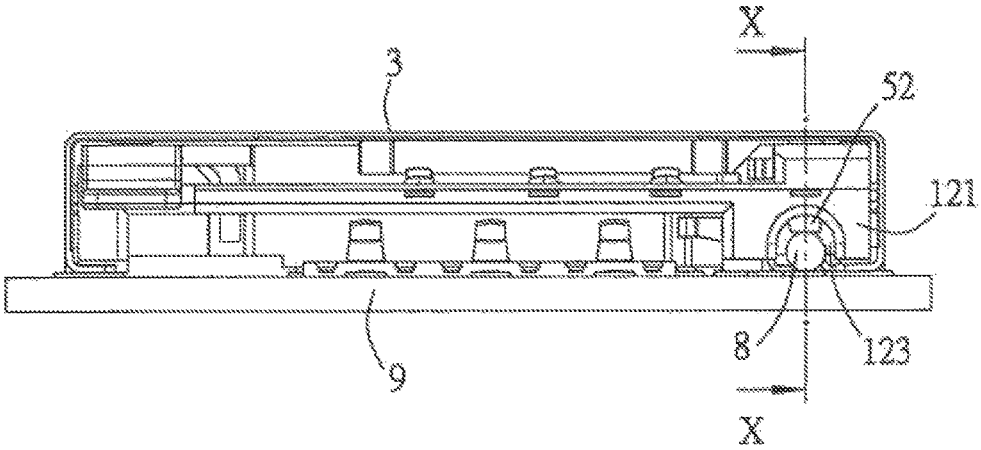
FIG. 9 is a view similar to FIG. 7 illustrating a pin-like element is inserted into the through-hole.
Figure 10:
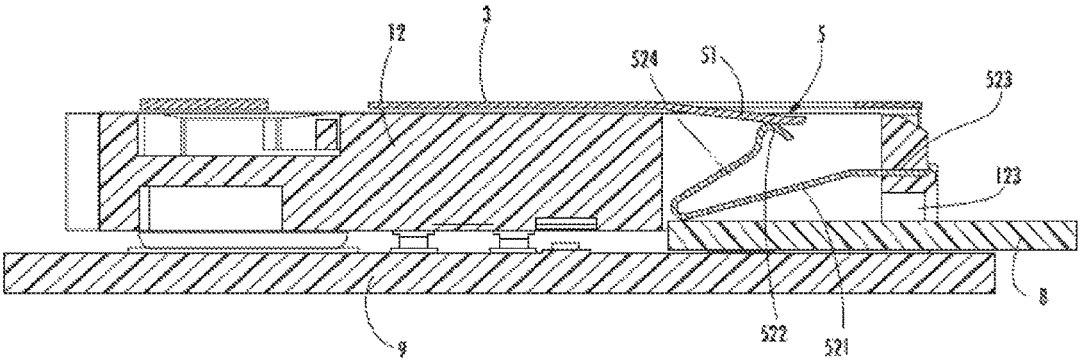
FIG. 10 is a cross sectional view taken along a line X-X of FIG. 9 and illustrating the switch unit is enabled by the pin-like element.

Referring to FIG. 4, FIG. 9 and FIG. 10, a pin-like element 8 may be inserted into the through-hole 123 to enable the switch unit 5. The pin-like element 8 enters into the through-hole 123 and then pushes the pushed portion 521 which drives the connecting portion 524 and the contact portion 522 to move, so as to allow the contact portion 522 to contact the abutting portion 51, so that the switch unit 5 is in an electrical connection. That is, a contact state between the resilient terminal 52 with the abutting portion 51 may be changed due to pushing the resilient terminal 52 by the pin-like element 8, in the embodiment, a state that the resilient terminal 52 does not contact the abutting portion 51 (i.e. the electrical disconnection) is changed to a state that the resilient terminal 52 contacts the abutting portion 51 (i.e. the electrical connection). Therefore, it may allow the switch unit 5 to generate a signal to start a default operation.

For example, the switch unit 5 can act as a reset switch, when the switch unit 5 is enabled by the pin-like element 8, a circuit system of an electronic device (not shown) provided with the electrical connector 100 may be reset. As such, in comparison with that a switch apparatus (not shown) is generally provided separately, the switch unit 5 is incorporated in the electrical connector 100, so that a space occupied by the switch apparatus and manufacture cost may be significantly saved. Moreover, when the electrical connector 100 is assembled in an electronic device, such as a mobile phone (not shown), and make the through-hole 123 exposed to the outside or an aperture is opened in a casing of the electronic device and is communicated with the through-hole 123, once the mobile phone crashes, a user needs not to open the mobile phone, instead directly inserts the pin-like element 8 into the through-hole 123 from the outside of the casing so as to enable the switch unit 5, therefore the reset function to restart the mobile phone can be achieved.

Figure 11:
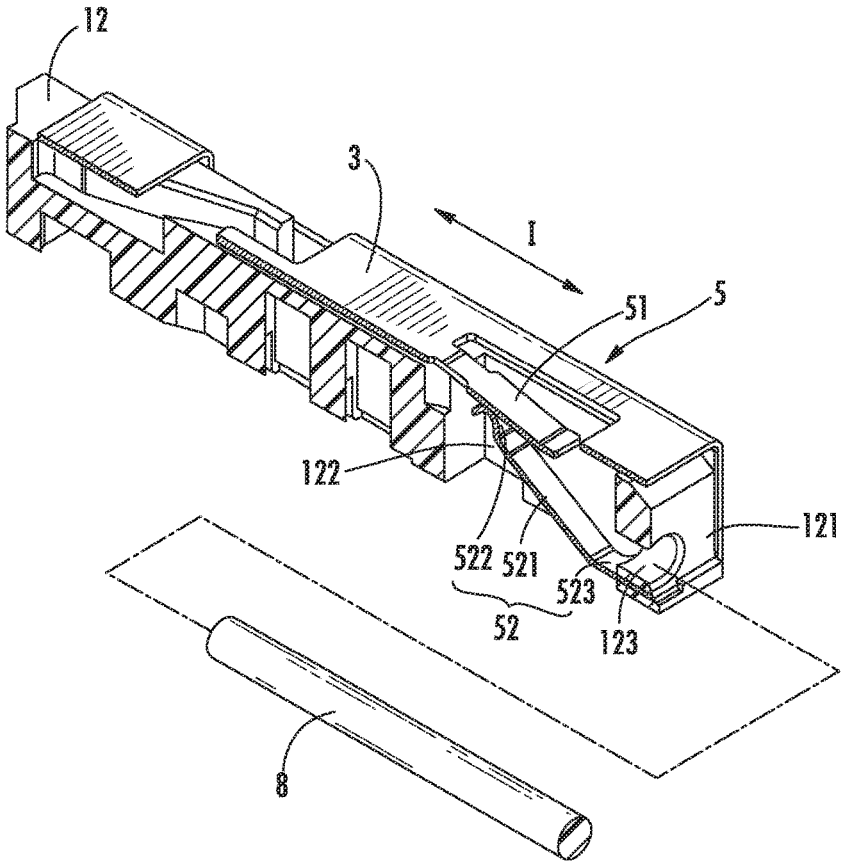
FIG. 11 is a perspective cut-away view illustrating an assembling relationship between a switch unit and an housing of a second embodiment of the electrical connector.
Figure 12:
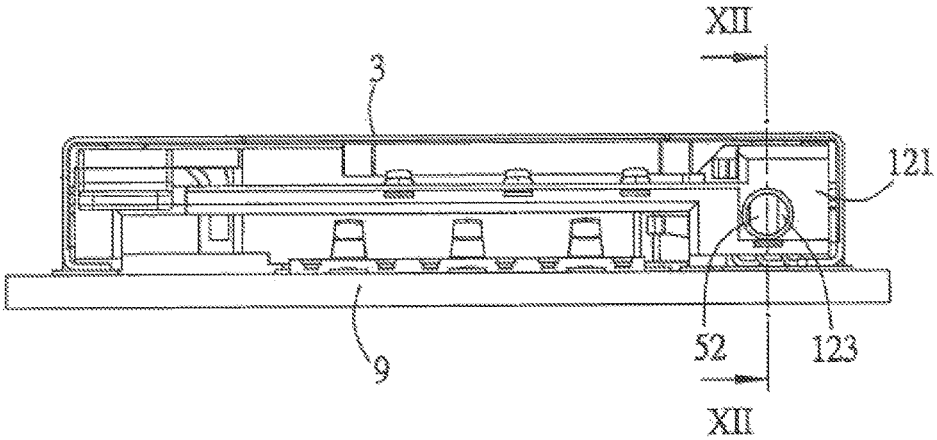
FIG. 12 is a front view illustrating a positional relationship between the switch unit and a through-hole.
Figure 13:
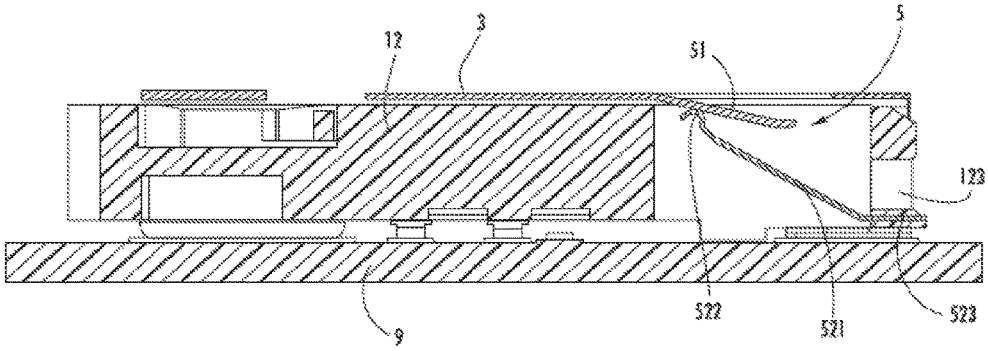
FIG. 13 is a cross sectional view taken along a line XIII-XIII of FIG. 12 and illustrating the switch unit in a normal state.

Referring to FIGS. 11-13, a second embodiment of the electrical connector 100 is similar to the first embodiment, but is different in that the fixed portion 523 of the resilient terminal 52 is fixed to the housing 1 and is positioned under the through-hole 123, the pushed portion 521 extends obliquely and upwardly from a position of the fixed portion 523 adjacent to the through-hole 123, the contact portion 522 directly extends from the distal end of the pushed portion 521 without connection via the connecting portion 524 and contacts the abutting portion 51 in a normal state. That is, in the second embodiment the switch unit 5 is in an electrical connection in the normal state.

Figure 14:
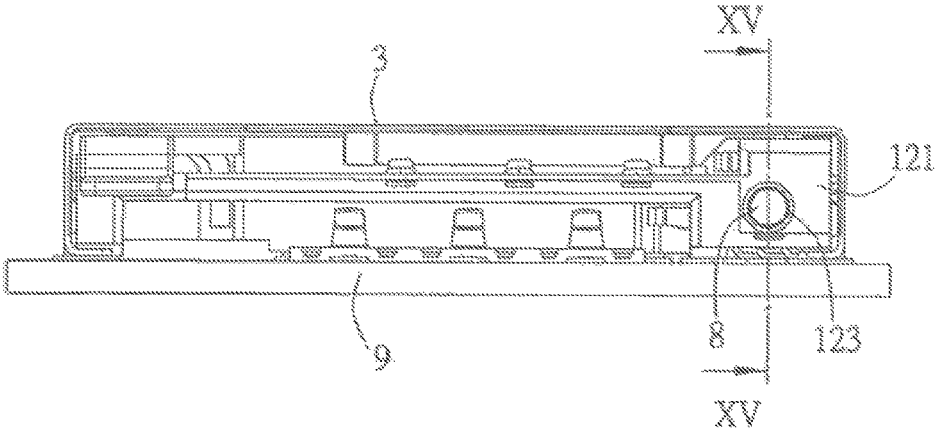
FIG. 14 is a view similar to FIG. 12 and illustrates a pin-like element inserted into the through-hole.
Figure 15:
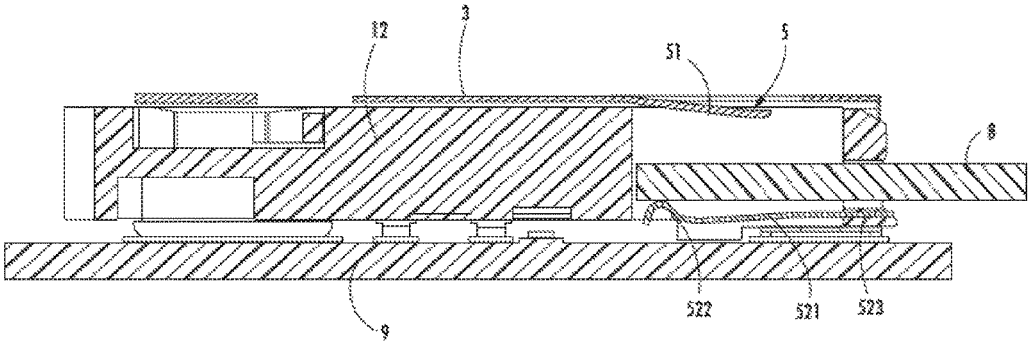
FIG. 15 is a cross sectional view taken along a line XV-XV of FIG. 14 and illustrating the switch unit of the second embodiment is enabled by pin-like element.

Referring to FIG. 14 and FIG. 15, when the pin-like element 8 enters into the through-hole 123 and pushes the pushed portion 521 which in turn drives the contact portion 522 to move, so that the contact portion 522 is separated from the abutting portion 51, and thus the switch unit 5 is in state of electrical disconnection. In the embodiment, a contact state between the resilient terminal 52 and the abutting portion 51 may also be changed due to pushing the resilient terminal 52 by the pin-like element 8, that is, a state that the resilient terminal 52 contacts the abutting portion 51 (the electrical disconnection) is changed to a state that the resilient terminal 52 does not contact the abutting portion 51 (the electrical disconnection), similarly an effect of allowing the switch unit 5 to generate a signal to start a default operation can be achieved.

It should be especially noted that although both of the first embodiment and the second embodiment are described by taking the electrical connector 100, which has the slots 101, 103 in two layers to allow insertion of two electronic cards (not shown), as an example, however, the switch unit 5 may be also provided to an electrical connector with a slot in a single layer.

However, the above described are only the specific embodiments, which are not intended to limit the scope of the claims of the present disclosure, namely simple equivalent variations and modifications made according to the claims and the content of the present disclosure are still fallen within the scope of the claims provided herein.

What is claimed is:

1. An electrical connector, comprising:

a housing having a base and a side wall connected to a side edge of the base, the side wall extending along a card insertion direction and having an end face;

a cage engaged with the housing, the cage and the housing together defining a slot, and an entrance of the slot being adjacent to the end face; and a switch unit provided to the side wall, the side wall further having a mounting space receiving the switch unit and a through-hole extending from the end face of the side wall and extending into the mounting space along the card insertion direction, the switch unit including a resilient terminal with a pushed portion obliquely facing the through-hole and a contact portion for engaging an abutting portion, so that, in operation a pin-like element can be inserted into the through-hole to press against the pushed portion and enable the switch unit.

2. The electrical connector according to claim 1, wherein the abutting portion is formed to the cage and a resilient terminal fixed in the housing, wherein, in operation, the resilient terminal can be enabled by the pin-like element so as to change a contact state between the resilient terminal and the abutting portion.

3. The electrical connector according to claim 1, wherein the abutting portion is a protruding piece formed by integrally punching the cage and, the protruding piece extends into the mounting space.

4. The electrical connector according to claim 3, wherein the abutting portion has resilience.

5. The electrical connector according to claim 2, wherein the resilient terminal further has a fixed portion fixed to the housing and positioned above the through-hole, a connecting portion connecting the pushed portion and the contact portion, and a soldering portion extending from the fixed portion and extending out from the housing, the pushed portion extends obliquely and downwardly from a position of the fixed portion adjacent to the through-hole, and the connecting portion is reversely bent from the pushed portion and extends obliquely and upwardly, the contact portion extends from a distal end of the connecting portion and is separated from the abutting portion in a normal state, but when the pin-like element enters into the through-hole and contacts and pushes the pushed portion and the pushed portion in turn drives the connecting portion and the contact portion to move, the contact portion contacts the abutting portion.

6. The electrical connector according to claim 2, wherein the resilient terminal further has a fixed portion fixed to the housing and positioned under the through-hole, and a soldering portion extending from the fixed portion and extending out from the housing, the pushed portion extends obliquely and upwardly from a position of the fixed portion adjacent to the through-hole, the contact portion extends from a distal end of the pushed portion and contacts the abutting portion in a normal state, but when the pin-like element enters into from the through-hole and pushes the pushed portion and the pushed portion in turn drives the contact portion to move, the contact portion is separated from the abutting portion.

* * * * *